United States Patent [19]

Goulde

[11] 4,143,766

[45] Mar. 13, 1979

[54] DEVICE FOR PROTECTING ARTICLES

[75] Inventor: David W. Goulde, Knoxville, Tenn.

[73] Assignee: Container Corporation of America, Chicago, Ill.

[21] Appl. No.: 894,935

[22] Filed: Apr. 10, 1978

[51] Int. Cl.[2] ..... B65D 85/48

[52] U.S. Cl. ..... 206/453

[58] Field of Search ..... 248/345.1; 229/14 C, 229/DIG. 1, DIG. 4; 206/453, 454, 586

[56] References Cited

U.S. PATENT DOCUMENTS

| | | | |
|---|---|---|---|
| 2,226,601 | 12/1940 | Euller | 206/453 |
| 2,885,139 | 5/1959 | Werner et al. | 206/453 |
| 3,482,759 | 12/1969 | Ortiz | 206/453 |
| 3,511,464 | 5/1970 | Doll | 248/345.1 |
| 3,661,252 | 5/1972 | Weichberger | 206/453 |
| 3,822,036 | 7/1974 | Goodsite | 229/DIG. 1 |

FOREIGN PATENT DOCUMENTS

| | | |
|---|---|---|
| 1135814 | 8/1955 | France. |
| 171200 | 11/1933 | Switzerland. |
| 245312 | 1/1926 | United Kingdom. |

*Primary Examiner*—Herbert F. Ross

*Attorney, Agent, or Firm*—Carpenter & Ostis

[57] ABSTRACT

The device protects a corner of an article, such as a sheet of glass, by receiving and cushioning the corner during shipment or storage of the article.

3 Claims, 4 Drawing Figures

DEVICE FOR PROTECTING ARTICLES

BACKGROUND OF THE INVENTION

1. Field of the Invention

This invention relates to an article protecting device and, more particularly, to a device formed from paperboard, or the like, for protecting a corner of an article, such as a sheet of glass, plate mirror, or the like, when the same is in shipment or storage.

2. The Prior Art

The existing art pertaining to devices similar in nature to the device disclosed in this application is best represented by the following United States Letters Patents:

| PATENTEE | PATENT NO. | CLASS |
|---|---|---|
| H. C. Miller | 1,998,515 | 206-62 |
| G. B. Weber et al | 2,006,224 | 206-60 |
| R. B. Euller | 2,226,601 | 206-60 |
| A. A. Werner et al | 2,885,139 | 229-14 |
| J. R. Goodsite | 3,822,036 | 229-14 |

and the following French patents:

1,135,813

1,411,781

None of the above patents, however, disclose a structure which folds from a single blank into a multi-ply, triangular device with a pocket of the present construction for receiving a corner of an article or the like. The French Pat. No. 1,135,813, which at first glance appears to be pertinent, actually discloses a triangular pad having four thicknesses throughout without any means for receiving and enclosing a portion of the article to be protected. The pad merely fills up a corner of an outer container preventing contact between the packaged article and the corner of the container.

SUMMARY OF THE INVENTION

A pocket for receiving a portion of an article, such as a corner of a sheet of glass, is formed from a pair of triangular panels folded against each other to provide multi-ply protection for the corner or the like.

DRAWINGS

Figure 2:
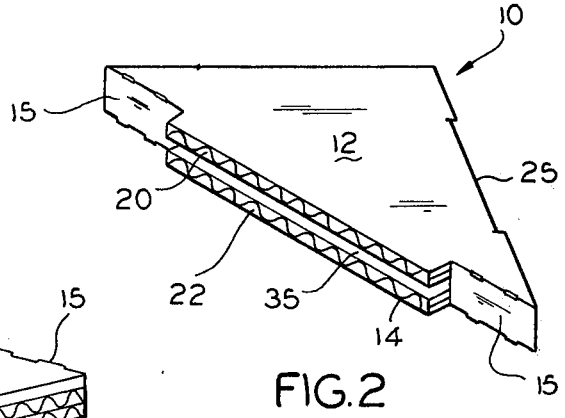
FIG. 2 is a perspective view of the device of the present invention viewed from the front.
Figure 3:
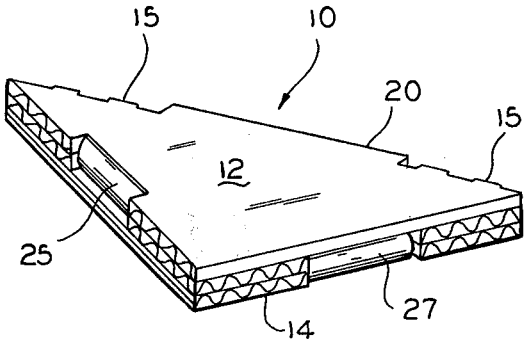
FIG. 3 is a perspective view of the device of the present invention viewed from the rear.
Figure 4:
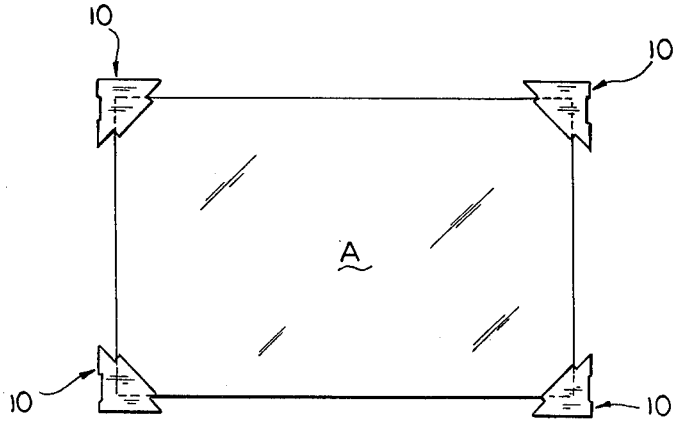
FIG. 4 is a plan view illustrating an article being protected by the devices of the present invention.

Referring now to the drawing, FIGS. 2 and 3 illustrate a device, generally designated 10, for protecting corners of an article A as shown in FIG. 4.

Figure 1:
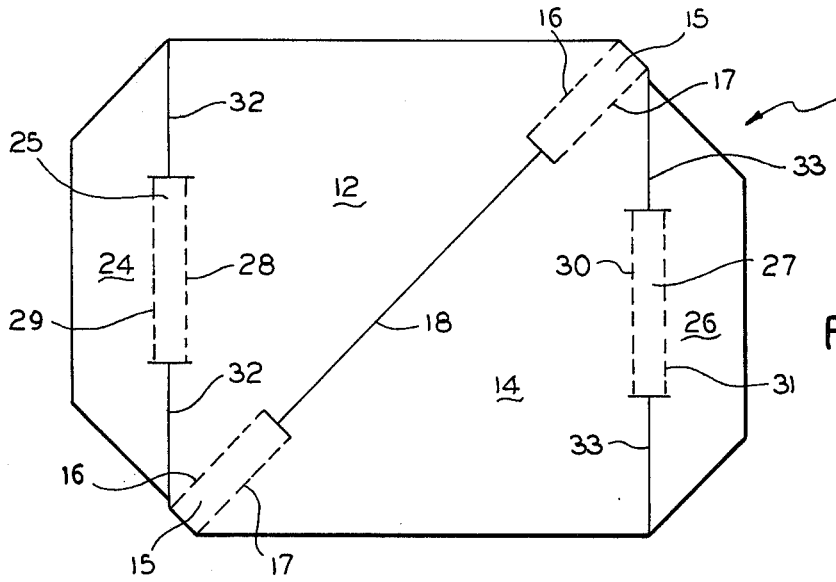
FIG. 1 is a plan view of a blank from which the device of the present invention is formed.

The device 10 is formed from a blank 11 of suitably cut and scored paperboard, or the like, seen in FIG. 1, and has a pair of substantially triangular main panels 12 and 14 foldably joined to each other by a pair of relatively narrow hinge strips 15.

The hinge strips 15 are formed from material of the panels 12 and 14 and are defined by a pair of score lines 16 and 17. The strips 15 are spaced from each other at opposite corners of the panels 12 and 14. A cut line 18 extends between the strips, separates the panels 12 and 14 from each other and defines opposed diagonal edges 20 and 22 of the panels 12 and 14, respectively.

A flap 24 is hinged to the panel 12 by a flap hinge strip 25, while a flap 26 is hinged to the panel 14 by a similar hinge strip 27. The hinge strips 25 and 27 are formed from material of the respective flaps and panels and are defined by a pair of parallel score lines 28, 29 and 30, 31, respectively. Cut lines 32 and 33 separate the flaps 24 and 26 from the panels 12 and 14, respectively, except in the areas of flap hinge strips 25 and 27.

As best seen in FIGS. 2 and 3 the flaps 24 and 26 are folded against their respective main panels 12 and 14 and are sandwiched between said main panels when these are folded against each other along the hinge strips 15.

A receiving pocket 35 is formed by the folded main panels 12 and 14 with the flaps 24 and 26 interposed therebetween to receive a portion, such as a corner, of an article, such as a plate mirror or a sheet of glass, to protect the same, as best seen in FIG. 4.

I claim:

1. A device erected from a blank of paperboard, or the like, for receiving and protecting a portion of an article, such as a corner of a sheet of glass, said device comprising:

(a) first and second main panels of substantially triangular configuration overlying each other and being foldably joined to each other along their diagonal edges by a pair of relatively narrow panel hinge strips formed from material of said panels and spaced from each other at opposite corners of said panels with a cut line extending therebetween;

(b) a flap hinged to another edge of at least one of said panels by a relatively narrow flap hinge strip and being sandwiched between said panels thereby providing a slot between said panels;

(c) said slot extending between said panel hinge strips the length of said cut line and forming a pocket for receiving a portion of an article to be protected.

2. A device as defined in claim 1, wherein each of said main panels has a flap hinged thereto and sandwiched between said panels.

3. A device as defined in claim 2, wherein said flaps sandwiched between said panels meet at a corner of said device, said corner forming a 90° angle and being spaced from said diagonal edges by said panels.

* * * * *